US005913752A

United States Patent [19]

Bolf

[11] Patent Number: 5,913,752

[45] Date of Patent: Jun. 22, 1999

[54] TOTAL BODY EXERCISE MACHINE

[76] Inventor: James W. Bolf, P.O. Box 154, Mesa, Ariz. 85211

[21] Appl. No.: 09/003,645

[22] Filed: Jan. 7, 1998

[51] Int. Cl.[6] ..... A63B 22/00

[52] U.S. Cl. ..... 482/72; 482/95; 482/112

[58] Field of Search ..... 482/51, 72, 57, 482/73, 92, 95, 96, 111, 112, 121–123, 125, 133–137, 139, 142, 507, 508

[56] References Cited

U.S. PATENT DOCUMENTS

| | | | |
|---|---|---|---|
| 2,405,024 | 7/1946 | Eynon | 482/72 |
| 4,641,833 | 2/1987 | Trethewey | 482/95 |
| 5,152,732 | 10/1992 | Sayre | 482/112 |
| 5,423,731 | 6/1995 | Chen | 482/72 |
| 5,529,557 | 6/1996 | Barton | 482/112 |
| 5,584,785 | 12/1996 | Wu | 482/95 |
| 5,624,361 | 4/1997 | Lai | 482/130 |

FOREIGN PATENT DOCUMENTS

| | | | |
|---|---|---|---|
| 90/14132 | 11/1990 | WIPO | 482/73 |

*Primary Examiner*—Jeanne M. Clark

[57] ABSTRACT

A total body exercise machine including a frame member. An adjustable seat portion is adjustably coupled with the frame member. An adjustable hand and foot exercise component is pivotally disposed with respect to the frame member intermediate forward and rearward ends thereof. The exercise component includes an adjustable sleeve. The adjustable sleeve has an open upper end and an open lower end. The exercise component includes an adjustable hand lever coupled with respect to the open upper end of the adjustable sleeve. The exercise component includes an adjustable foot lever coupled with respect to the open lower end of the adjustable sleeve. A plurality of forward shocks are secured between the forward end of the frame member and the hand and foot exercise component. A plurality of rearward shocks are secured between the rearward end of the frame member and the hand and foot exercise component.

5 Claims, 2 Drawing Sheets

TOTAL BODY EXERCISE MACHINE

BACKGROUND OF THE INVENTION

1. Field of the Invention

The present invention relates to a total body exercise machine and more particularly pertains to allowing for all of the body's muscles to be exercised with a total body exercise machine.

2. Description of the Prior Art

The use of exercise machines is known in the prior art. More specifically, exercise machines heretofore devised and utilized for the purpose of exercising muscle groups are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,421,795 to Chen; U.S. Pat. No. 5,356,356 to Hildebrandt et al.; U.S. Pat. No. 5,104,363 to Shi; U.S. Pat. No. 4,300,760 to Bobroff; U.S. Pat. No. Des. 356,128 to Smith et al.; and U.S. Pat. No. 4,641,833 to Trethewey.

While these devices fulfill their respective, particular objective and requirements, the aforementioned patents do not describe a total body exercise machine for allowing for all of the body's muscles to be exercised.

In this respect, the total body exercise machine according to the present invention substantially departs from the conventional concepts and designs of the prior art, and in doing so provides an apparatus primarily developed for the purpose of allowing for all of the body's muscles to be exercised.

Therefore, it can be appreciated that there exists a continuing need for new and improved total body exercise machine which can be used for allowing for all of the body's muscles to be exercised. In this regard, the present invention substantially fulfills this need.

SUMMARY OF THE INVENTION

In the view of the foregoing disadvantages inherent in the known types of exercise machines now present in the prior art, the present invention provides an improved total body exercise machine. As such, the general purpose of the present invention, which will be described subsequently in greater detail, is to provide a new and improved total body exercise machine and method which has all the advantages of the prior art and none of the disadvantages.

To attain this, the present invention essentially comprises a frame member comprising a pair of inverted U-shaped longitudinal supports in a spaced relationship. The longitudinal supports have downwardly extending end portions secured to front and rear latitudinal foot pads. The longitudinal supports each have foot pegs extending outwardly from forward ends thereof. The longitudinal supports have forward and rearward support brackets extending therebetween. An adjustable seat portion is adjustably coupled with rearward ends of the longitudinal supports. An adjustable hand and foot exercise component is pivotally disposed between the longitudinal supports of the frame member intermediate the forward and rearward ends thereof. The exercise component includes an adjustable sleeve positioned between the longitudinal supports. A pivot pin extends through adjustable sleeve and the pair of longitudinal supports. The pivot pin has ball bearings disposed therearound. The adjustable sleeve has an open upper end and an open lower end. The adjustable sleeve has a pair of brackets secured to opposing sides thereof. The brackets have forward and rearward cross bars extending therebetween. The exercise component includes an adjustable hand lever. The hand lever has a vertical support post adjustably received within the open upper end of the adjustable sleeve. The vertical support post has a U-shaped handle secured to an upper free end thereof. Free ends of the U-shaped handle have inwardly extending grip portions. The exercise component includes an adjustable foot lever. The foot lever has a support post adjustably received within the open lower end of the adjustable sleeve. The support post has an outwardly curved lower end. The outwardly curved lower end has a horizontal support post secured thereto. A pair of foot pedals with associated straps are secured to opposing ends of the horizontal support post. A plurality of forward shocks are secured between the forward support bracket of the main frame and the forward cross bar of the hand and foot exercise component. A plurality of rearward shocks are secured between the rearward support bracket of the main frame and the rearward cross bar of the hand and foot exercise component.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved total body exercise machine which has all the advantages of the prior art exercise machines and none of the disadvantages.

It is another object of the present invention to provide a new and improved total body exercise machine which may be easily and efficiently manufactured and marketed.

It is a further object of the present invention to provide a new and improved total body exercise machine which is of durable and reliable construction.

An even further object of the present invention is to provide a new and improved total body exercise machine which is susceptible of a low cost of manufacture with regard to both materials and labor, and which accordingly is then susceptible of low prices of sale to the consuming public, thereby making such a total body exercise machine economically available to the buying public.

Even still another object of the present invention is to provide a new and improved total body exercise machine for allowing for all of the body's muscles to be exercised.

Lastly, it is an object of the present invention to provide a new and improved total body exercise machine including a frame member. An adjustable seat portion is adjustably coupled with the frame member. An adjustable hand and foot exercise component is pivotally disposed with respect to the frame member intermediate forward and rearward ends thereof. The exercise component includes an adjustable sleeve. The adjustable sleeve has an open upper end and an open lower end. The exercise component includes an adjustable hand lever coupled with respect to the open upper end of the adjustable sleeve. The exercise component includes an adjustable foot lever coupled with respect to the open lower end of the adjustable sleeve. A plurality of forward shocks are secured between the forward end of the frame member and the hand and foot exercise component. A plurality of rearward shocks are secured between the rearward end of the frame member and the hand and foot exercise component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
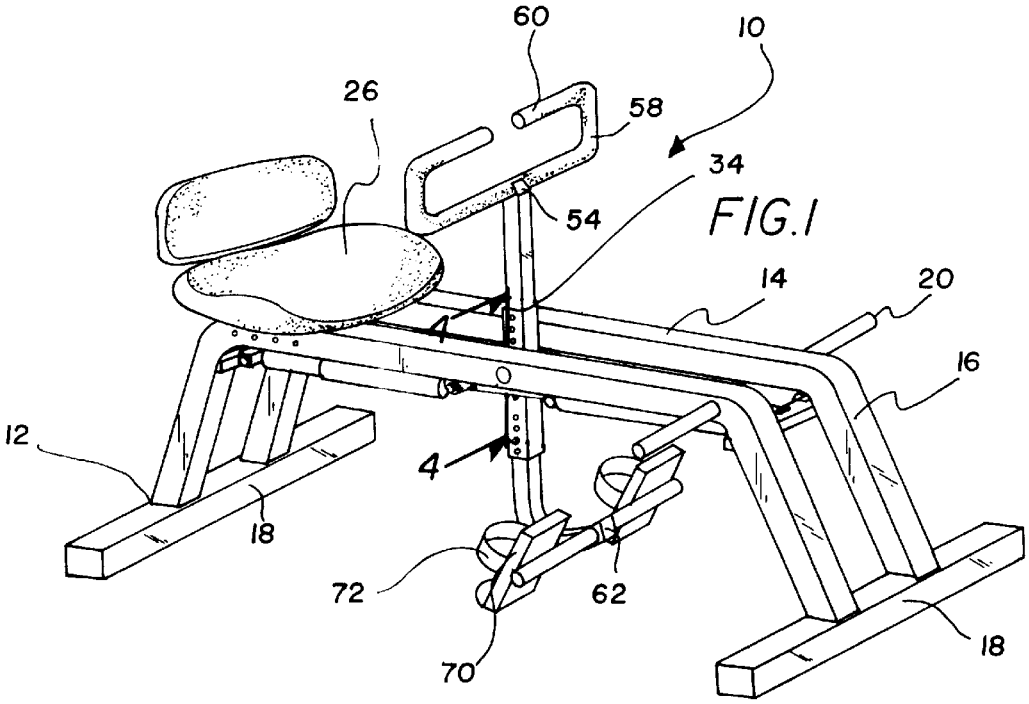
FIG. 1 is a perspective view of the preferred embodiment of the total body exercise machine constructed in accordance with the principles of the present invention.
Figure 2:
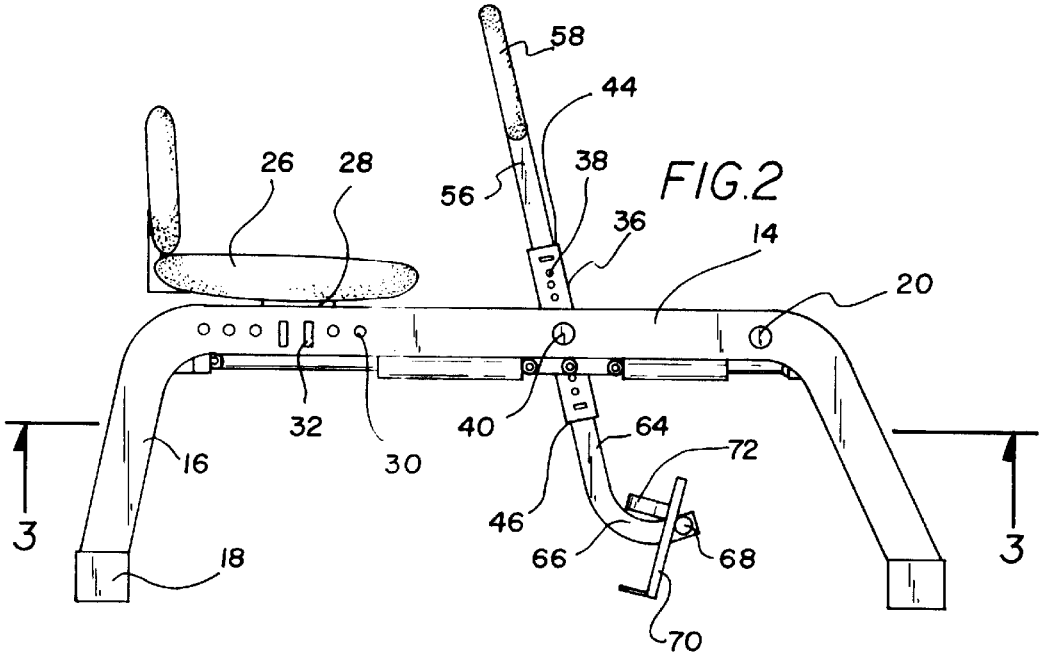
FIG. 2 is a side elevation view of the present invention.
Figure 3:
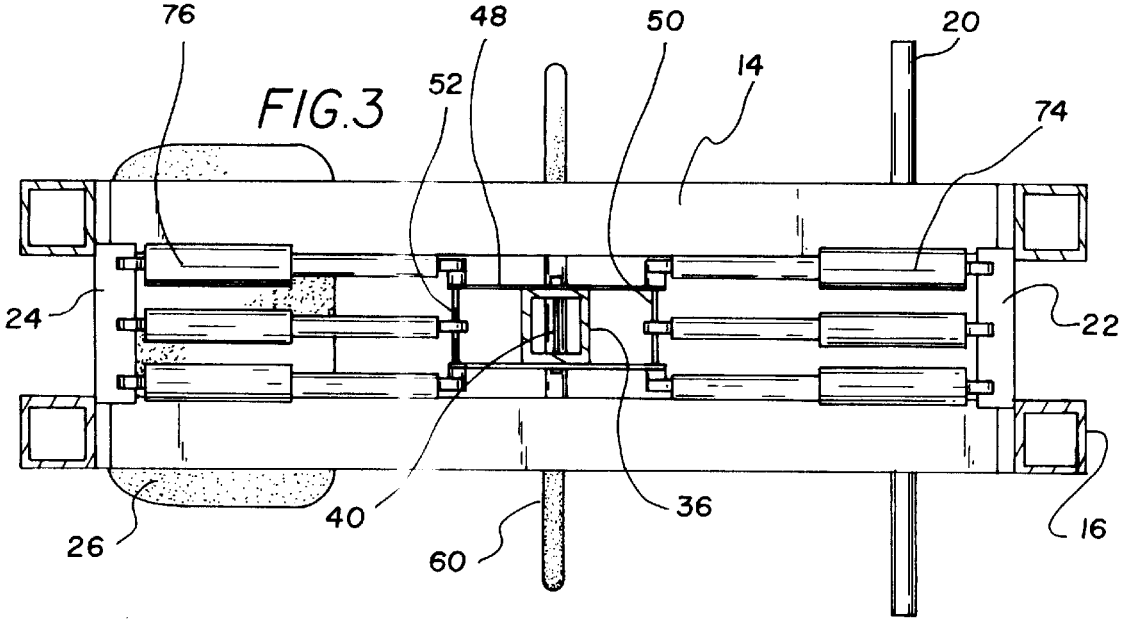
FIG. 3 is a cross-sectional view as taken along line 3—3 of FIG. 2.
Figure 4:
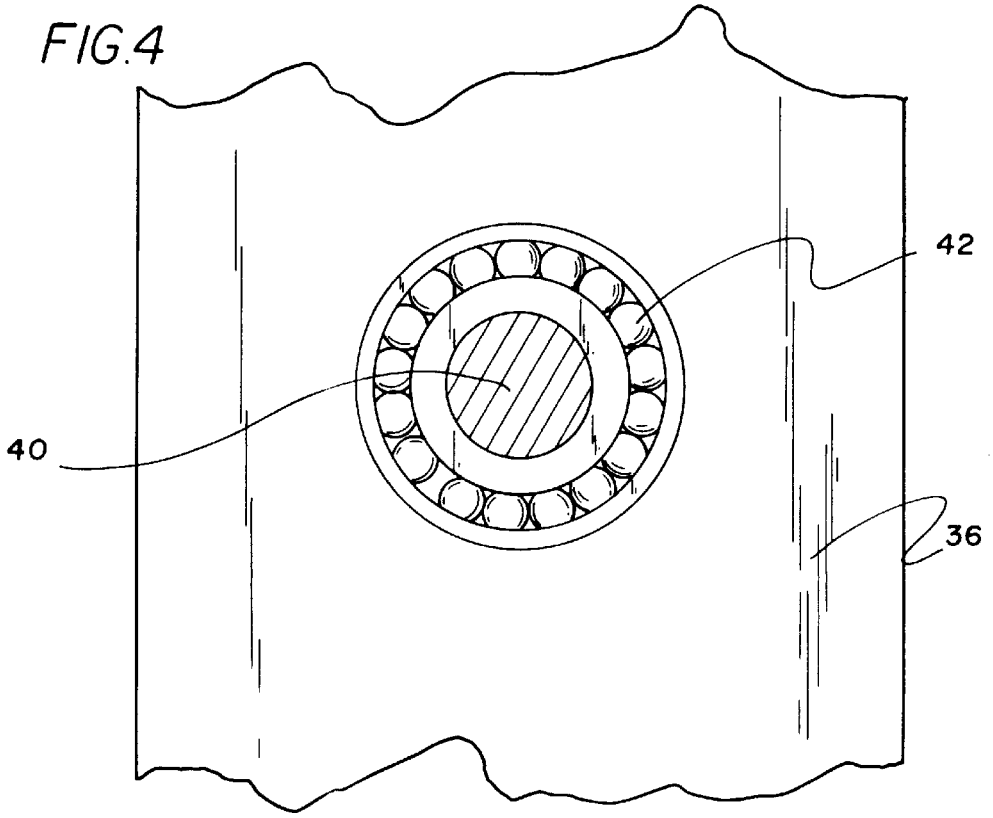
FIG. 4 is cross-sectional view as taken along line 4—4 of FIG. 1.

With reference now to the drawings, and in particular, to FIGS. 1 through 4 thereof, the preferred embodiment of the new and improved total body exercise machine embodying the principles and concepts of the present invention and generally designated by the reference number 10 will be described.

Specifically, it will be noted in the various Figures that the device relates to a total body exercise machine for allowing for all of the body's muscles to be exercised. In its broadest context, the device consists of a frame member, an adjustable seat portion, an adjustable hand and foot exercise component, a plurality of forward shocks and a plurality of rearward shocks. Such components are individually configured and correlated with respect to each other so as to attain the desired objective.

The frame member 12 comprises a pair of inverted U-shaped longitudinal supports 14 in a spaced relationship. The longitudinal supports 14 have downwardly extending end portions 16 secured to front and rear latitudinal foot pads 18. The longitudinal supports 14 each have foot pegs 20 extending outwardly from forward ends thereof. The longitudinal supports 14 have forward and rearward support brackets 22,24 extending therebetween.

The adjustable seat portion 26 is adjustably coupled with rearward ends of the longitudinal supports 14. The seat portion 26 is slidable between the pair of longitudinal supports 14. The seat portion 26 includes a bracket 28 that is in alignment with the longitudinal supports 14. The bracket 28 has apertures therethrough with associated apertures 30 through the longitudinal supports 14 for receiving locking pins 32 therethrough to lock the seat portion 26 to preclude further sliding.

The adjustable hand and foot exercise component 34 is pivotally disposed between the longitudinal supports 14 of the frame member 12 intermediate the forward and rearward ends thereof. The exercise component 34 includes an adjustable sleeve 36 positioned between the longitudinal supports 14. The adjustable sleeve 36 has a plurality of apertures 38 therethrough in a vertical orientation. A pivot pin 40 extends through adjustable sleeve 36 and the pair of longitudinal supports 14. The pivot pin 40 has ball bearings 42 disposed therearound. The adjustable sleeve 36 has an open upper end 44 and an open lower end 46. The adjustable sleeve 36 has a pair of brackets 48 secured to opposing sides thereof. The brackets 48 have forward and rearward cross bars 50,52 extending therebetween. The exercise component 34 includes an adjustable hand lever 54. The hand lever 54 has a vertical support post 56 adjustably received within the open upper end 44 of the adjustable sleeve 36. The vertical support post 54 has a plurality of apertures therethrough for aligning with the apertures 38 of the adjustable sleeve 36 for receiving a locking pin to set the desired height of the hand lever 54. The vertical support post 56 has a U-shaped handle 58 secured to an upper free end thereof. Free ends of the U-shaped handle 58 have inwardly extending grip portions 60. The exercise component 34 includes an adjustable foot lever 62. The foot lever 62 has a support post 64 adjustably received within the open lower end 46 of the adjustable sleeve 36. The support post 64 has a plurality of apertures therethrough for aligning with the apertures 38 of the adjustable sleeve 36 for receiving a locking pin to set the desired distance the foot lever 62 is away from the user when on the seat portion 26. The support post 64 has an outwardly curved lower end 66. The outwardly curved lower end 66 has a horizontal support post 68 secured thereto. A pair of foot pedals 70 with associated straps 72 are secured to opposing ends of the horizontal support post 68.

The plurality of forward shocks 74 are secured between the forward support bracket 22 of the frame member 12 and the forward cross bar 50 of the hand and foot exercise component 34.

The plurality of rearward shocks 76 are secured between the rearward support bracket 24 of the frame member 12 and the rearward cross bar 52 of the hand and foot exercise component 34.

In use, a person adjusts the seat portion 26 to the desired position and sits down. The person then places their feet on the foot pedals 70 and grasp the grip portions 60. The person then pushes forward with their feet and pull rearward with their hands to exercise. The shocks 74, 76 provide resistance to the exercise causing the return to a prone position whereby the user continues with more repetitions.

It should be noted that the present invention offers adjustable resistance in both the forward direction and backward direction. As such, a user does not have to change anything to employ forward and rearward resistance. The present invention allows the body to be exercised as a whole or, in the alternative, major muscle groups can be exercised in isolation, to any extent, simply by adjusting the resistance of the shocks and moving the handle in the required direction.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A total body exercise machine for allowing for all of the body's muscles to be exercised comprising, in combination:

a frame member comprising a pair of inverted U-shaped longitudinal supports in a spaced relationship, the longitudinal supports having downwardly extending end portions secured to front and rear latitudinal foot pads, the longitudinal supports each having foot pegs extending outwardly from forward ends thereof, the longitudinal supports having forward and rearward support brackets extending therebetween;

an adjustable seat portion adjustably coupled with rearward ends of the longitudinal supports;

an adjustable hand and foot exercise component pivotally disposed between the longitudinal supports of the frame member intermediate the forward and rearward ends thereof, the exercise component including an adjustable sleeve positioned between the longitudinal supports, a pivot pin extending through adjustable sleeve and the pair of longitudinal supports, the pivot pin having ball bearings disposed therearound, the adjustable sleeve having an open upper end and an open lower end, the adjustable sleeve having a pair of brackets secured to opposing sides thereof, the brackets having forward and rearward cross bars extending therebetween, the exercise component including an adjustable hand lever, the hand lever having a vertical support post adjustably received within the open upper end of the adjustable sleeve, the vertical support post having a U-shaped handle secured to an upper free end thereof, free ends of the U-shaped handle having inwardly extending grip portions, the exercise component including an adjustable foot lever, the foot lever having a support post adjustably received within the open lower end of the adjustable sleeve, the support post having an outwardly curved lower end, the outwardly curved lower end having a horizontal support post secured thereto, a pair of foot pedals with associated straps secured to opposing ends of the horizontal support post;

a plurality of forward shocks secured between the forward support bracket of the frame member and the forward cross bar of the hand and foot exercise component; and a plurality of rearward shocks secured between the rearward support bracket of the frame member and the rearward cross bar of the hand and foot exercise component.

2. A total body exercise machine for allowing for all of the body's muscles to be exercised comprising, in combination:

a frame member having forward and rearward support brackets;

an adjustable seat portion adjustably coupled with the frame member;

an adjustable hand and foot exercise component pivotally disposed with respect to the frame member intermediate forward and rearward ends thereof, the exercise component including an adjustable sleeve, a pivot pin extending through the adjustable sleeve and the frame member, the pivot pin having ball bearings disposed therearound, the adjustable sleeve having an open upper end and an open lower end, the exercise component including an adjustable hand lever coupled with respect to the open upper end of the adjustable sleeve, the exercise component including an adjustable foot lever coupled with respect to the open lower end of the adjustable sleeve;

at least one forward shock secured between the forward end of the frame member and the hand and foot exercise component; and at least one rearward shock secured between the rearward end of the frame member and the hand and foot exercise component.

3. The total body exercise machine as set forth in claim 2 wherein the frame member comprises a pair of inverted U-shaped longitudinal supports in a spaced relationship, the longitudinal supports having downwardly extending end portions secured to front and rear latitudinal foot pads, the longitudinal supports each having foot pegs extending outwardly from forward ends thereof, the longitudinal supports having forward and rearward support brackets extending therebetween.

4. The total body exercise machine as set forth in claim 2 wherein the hand lever has a vertical support post adjustably received within the open upper end of the adjustable sleeve, the vertical support post has a U-shaped handle secured to an upper free end thereof, free ends of the U-shaped handle have inwardly extending grip portions.

5. The total body exercise machine as set forth in claim 2 wherein the foot lever has a support post adjustably received within the open lower end of the adjustable sleeve, the support post having an outwardly curved lower end, the outwardly curved lower end having a horizontal support post secured thereto, a pair of foot pedals with associated straps secured to opposing ends of the horizontal support post.

* * * * *